United States Patent [19]

Galvin

[11] 4,051,467

[45] Sept. 27, 1977

[54] FLUID FLOW DETECTOR FOR A FIRE ALARM SYSTEM

[75] Inventor: Aaron A. Galvin, Lexington, Mass.

[73] Assignee: American District Telegraph Company, Jersey City, N.J.

[21] Appl. No.: 655,436

[22] Filed: Feb. 5, 1976

[51] Int. Cl.[2] ..... G08B 21/00

[52] U.S. Cl. ..... 340/239 S; 340/409; 169/23

[58] Field of Search ..... 340/239 S, 240, 241, 340/234 R, 236, 409; 169/23; 73/40.5 R

[56] References Cited

U.S. PATENT DOCUMENTS

| | | | |
|---|---|---|---|
| 1,690,279 | 11/1928 | Craft | 340/253 R |
| 2,334,826 | 11/1943 | Lowe | 340/239.5 |
| 3,138,792 | 6/1964 | Jenkins et al. | 340/409 |
| 3,148,363 | 9/1964 | Gjerken | 340/213 R X |

*Primary Examiner*—John W. Caldwell

*Assistant Examiner*—Daniel Myer

*Attorney, Agent, or Firm*—Charles B. Smith; Robert R. Jackson

[57] ABSTRACT

A sprinkler flow detector which can detect and rapidly respond to the onset of water flow in a sprinkler system which results, for example, from the release of one or more sprinklers. The detector senses the pressure vs. time profile of the system or house side of the sprinkler system. An increase in pressure is accurately tracked without causing alarm. If, however, the pressure falls in excess of certain predetermined rates and amounts, and holds in the lower state for in excess of a second certain predetermined amount of time, the detector enters an alarm state. In a preferred embodiment the detector features a trouble state in which it responds to one of several monitored conditions, for example, a component failure in the detector electrical circuitry, excessive pressure in the sprinkler system, or dangerously low pressure in the sprinkler system.

18 Claims, 5 Drawing Figures

FLUID FLOW DETECTOR FOR A FIRE ALARM SYSTEM

FIELD OF THE INVENTION

This invention relates to alarm devices for a fire alarm system, and in particular, to a sprinkler flow detector which responds to the pressure of the fluid in the sprinkler system.

BACKGROUND OF THE INVENTION

The practice of protecting buildings against fire using an array of automatically-released sprinklers, interconnected to form a sprinkler system, has been used for many years. In recent years, an increasingly large percentage of new industrial buildings has been equipped with this type of protection. In its basic form, a sprinkler system consists of a network of pipes, which are charged at one end with a fluid under pressure from a fluid-supply source, interconnected with a series of branch lines which support the sprinklers. Generally there is a check valve between the fluid supply and the input of the sprinkler system piping, which prevents the possibly contaminated sprinkler fluid from backing up into the supply under conditions in which the supply pressure is low. This check valve also causes the peak pressure of the fluid supply to be "trapped" and stored in the sprinkler system. Each sprinkler contains an element which melts or breaks at a certain elevated temperature, causing a rapid release of fluid in a controlled pattern to extinguish the fire that originally caused the elevated temperature. Generally a sprinkler has no automatic shutoff provision, hence after the fire has been extinguished, the sprinkler fluid continues to flow, but types of sprinklers which automatically restore to a normal off condition after the sensed temperature has returned to normal recently have come into use. Most generally the fluid is water.

It is important to summon the fire department whenever a sprinkler has released because (1) a sprinkler is not 100 percent effective in putting out a fire, and it is possible that even with the sprinkler operating normally, the fire can grow to an uncontrolled level, and (2) a substantial amount of secondary damage can be caused by the continuous flow of water from the open sprinklers, if the water supply is not shut down. The sprinkler system, therefore, must have provisions for initiating a fire alarm upon release of water from one or more sprinklers.

There are a number of devices currently employed for providing an alarm when one or more sprinklers of a sprinkler system release. Although many of these devices provide an alarm if one or more sprinklers release, they have their disadvantages, such as relatively slow speed of response, relatively high equipment or intallation cost, and susceptability to false alarms (for example from a temporary waterflow resulting from city pressure surges compressing the air trapped in the sprinkler system).

It is an object of this invention to provide a sprinkler flow detector which is very high in speed of response, low in equipment and installation cost, and is highly immune to stimuli that can cause false alarms. Other objects of the invention include providing a detector which exhibits high detection reliability and can function properly in systems which use fast automatically-restoring sprinklers.

SUMMARY OF THE INVENTION

The invention features a sprinkler flow detector for providing an alarm signal whenever a predetermined condition of fluid flow exists in a sprinkler system. The sprinkler system comprises a system side containing a fluid under pressure. The system side has at least one outlet port, commonly a sprinkler, for allowing fluid, usually water, to escape from the system, and at least one inlet port for admitting fluid into the system. The detector includes a pressure transducer in communication with the system side for providing an electrical output signal from which the pressure of the fluid in the system can be determined. The detector also includes an electrical signal processing circuit for receiving the electrical output signal and for providing an alarm signal whenever excursions of the pressure within the system exceed at least one predetermined criterion.

The signal processing circuit features shaping circuitry including a bank-pass amplifier for providing a first output signal whereby transducer signals of less than a predetermined time duration or rate of change are prevented from causing alarm signals. The band-pass amplifier preferably has a low frequency cut off of substantially 0.025 Hertz and a high frequency cut off of substantially 1 Hertz. The signal processing circuit further features redundant elements whereby the failure of any one redundant element does not prevent normal operation of an alarm indicating portion of the signal processing circuit.

In a preferred embodiment, the signal processing circuit features circuitry for providing trouble alarms whenever the fluid pressure sensed by the pressure transducer either exceeds a first threshold or decreases below a second threshold.

DESCRIPTION OF THE DRAWINGS

Other objects, features, and advantages of the invention will be more fully understood from the following description taken in conjunction with the accompanying drawings in which.

DESCRIPTION OF A PREFERRED EMBODIMENT

Figure 1:
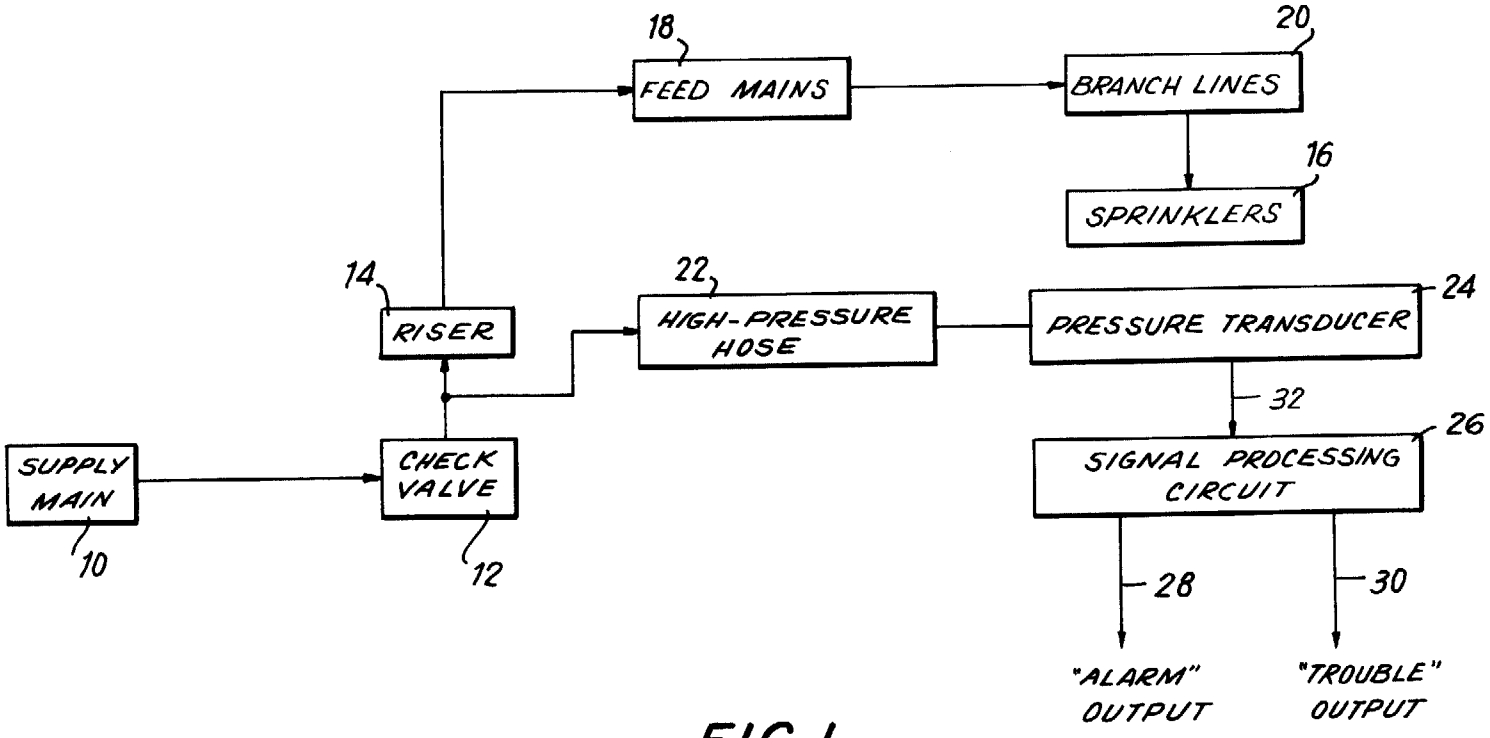
FIG. 1 is a simplified schematic diagram of a typical sprinkler system including the invention.

Referring to FIG. 1, the supply main 10 provides a source of fluid, in this embodiment water, through an inlet port, here check valve 12, to the system's riser 14, which is a pipe which feeds the sprinkler water vertically to the various levels of a building where the outlet ports, here sprinklers 16, are located. Feed mains 18 pick up the riser output and distribute it to various branch lines 20, which are the pipes on which the sprinklers are mounted. Risr 14, feed mains 18, branch lines 20 and sprinklers 16 (and interconnection hardware) constitute the system side of the sprinkler system for containing the high pressure fluid.

The fluid pressure within the system can be sampled at any portion of the system side (as opposed to the supply-main side) of the alarm check valve. A high-pressure hose 22 is most frequently connected to the check valve, where there generally is a fitting which supplies a sample of the pressure within the system side. A pressure transducer 24 in communication with the system side through the high pressure hose and an electrical signal processing circuit 26 responsive to an electrical output 32 of the pressure transducer provide output signals 28, 30 to a supervisory location.

Figure 2:
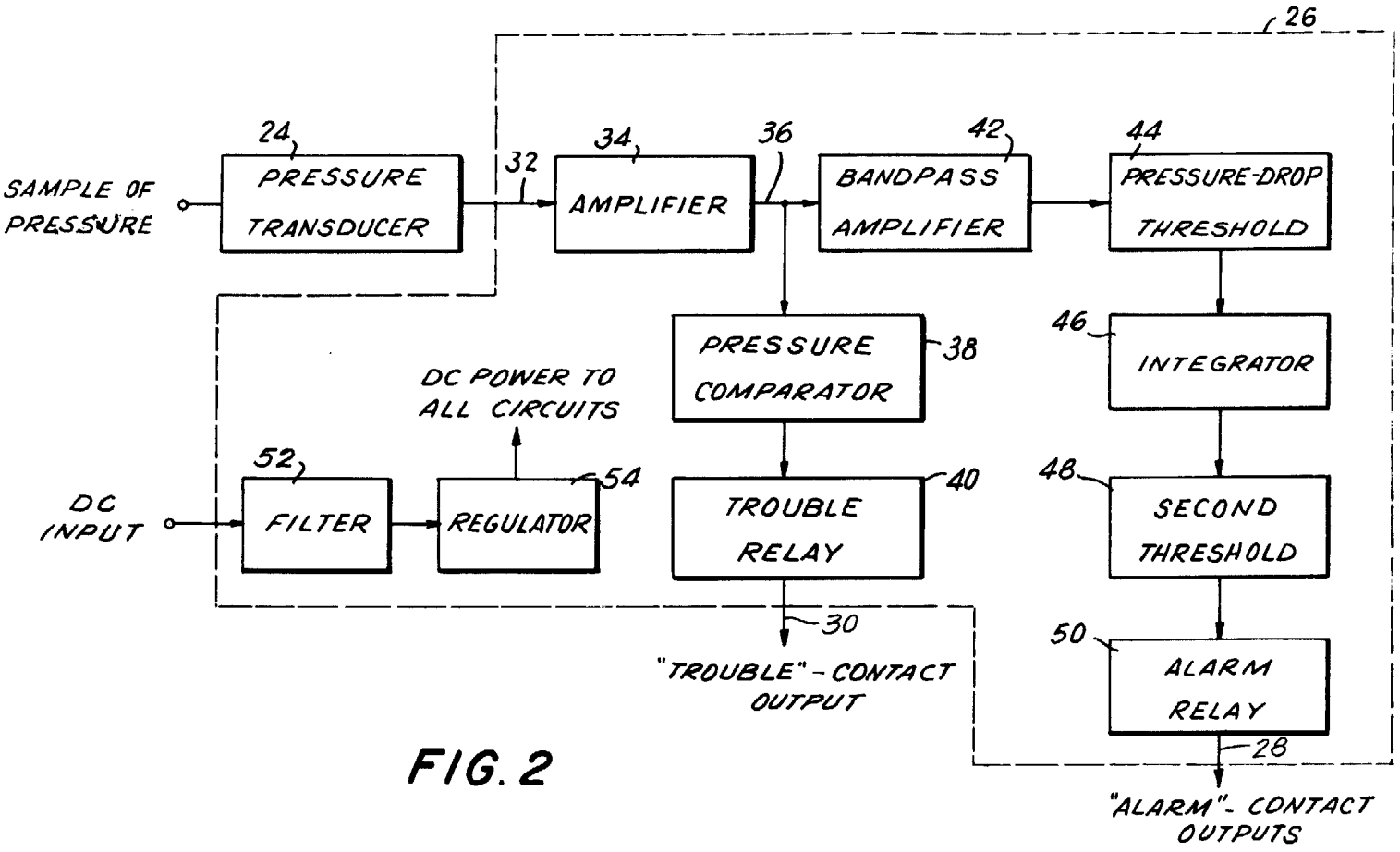
FIG. 2 is a simplified block diagram of the preferred embodiment of the invention.

Referring to FIG. 2, the electrical signal processing circuit 26 obtains its electrical input signal 32 from the output of pressure transducer 24 connected into the system side. The electrical output of transducer 24 is a voltage which varies in proportion to the measured gage pressure. This time varying signal is amplified by an amplifier 34. The output 36 of amplifier 34 is presented to two operating systems, one which is responsive to the absolute pressure level and the other which responds to the rate and duration of pressure drop. The absolute-pressure-level operating system has a lower and an upper threshold comparator 38 which when exceeded causes a trouble signal 30 to be generated through trouble relay 40.

The second operating system processes the amplified electrical signal 36, using a band-pass amplifier 42, the positive excursions of which (signifying pressure decreases) go to a threshold circuit 44, an integrator 46, and a second threshold circuit 48. If the output signal of amplifier 42 exceeds a first predetermined threshold, the pressure drop is sufficient to start a timing cycle. If a second threshold indicative of time duration is exceeded, the pressure drop has remained sufficiently long, and an alarm relay 50 is energized, thus signaling an alarm.

To allow reliable operation over a wide range of unfiltered DC input levels, a filter 52 and regulator 54 are provided between the input DC and the rest of the signal processing circuit.

The basic design shown in FIG. 2 is highly reliable, and would be subject to the periodic inspections, however, because of the strong requirement for an inordinate amount of reliability in fire alarm systems, in the preferred embodiment, additional circuitry is added to provide continued operation in the presence of virtually all single-component failures, and de-energization of the trouble relay to signal a trouble alarm in cases where a single failure has occurred and would prevent a proper alarm from being signalled in the event of waterflow.

Figure 3:
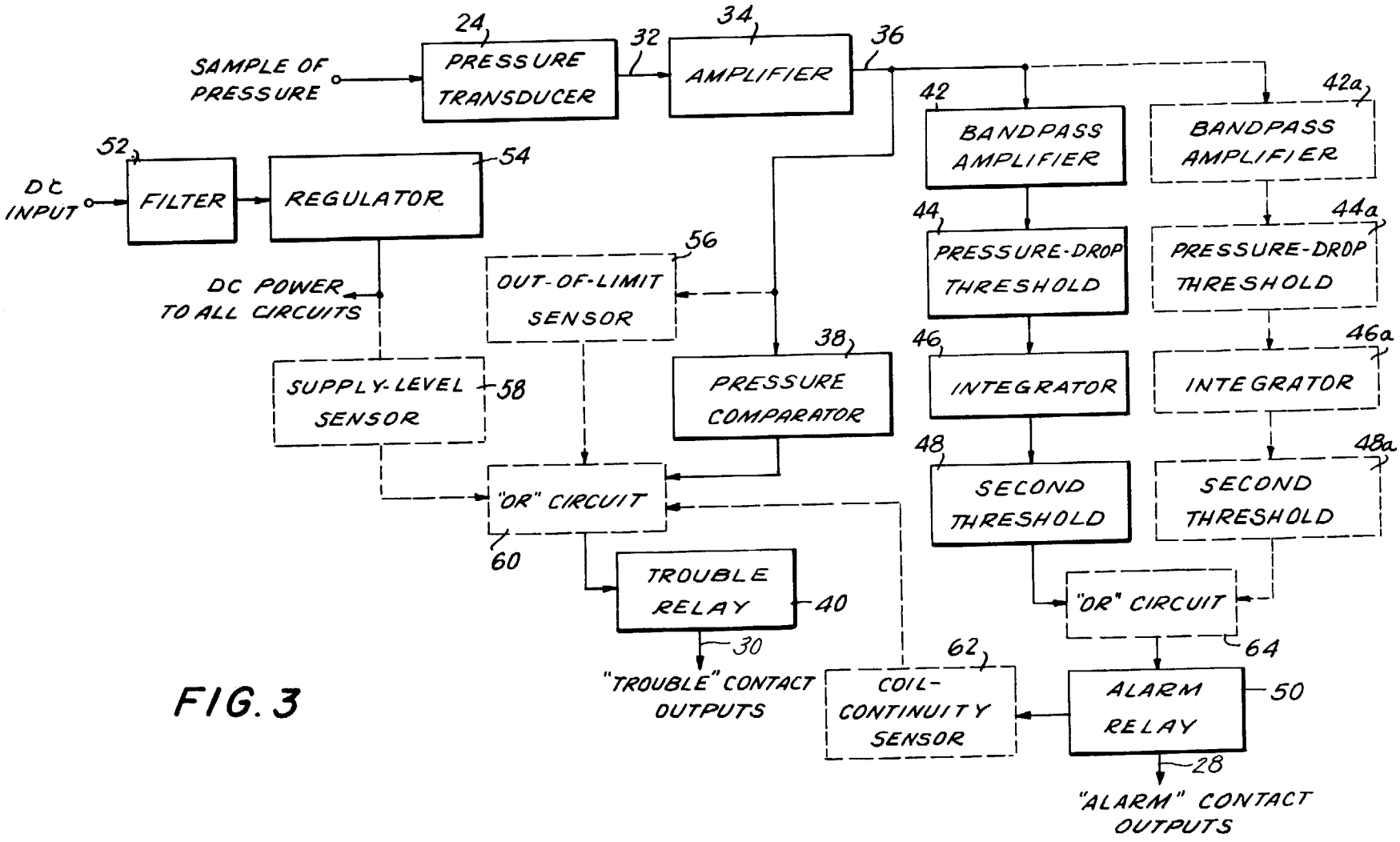
FIG. 3 is a simplified block diagram of the invention including several high-reliability features.

Referring to FIG. 3, the added high reliability circuitry is indicated by blocks having broken lines. Much of this added circuitry relates to detecting or monitoring a component failure. Thus, a level sensor 56 at the output of the amplifier 34 provides monitoring for proper operation of the pressure transducer 24 as well as amplifier 34. Component failures either in the pressure transducer or the amplifier would cause the amplifier output to exceed a certain level in either the positive or negative direction. The level sensor operates in conjunction with the existing comparator 38 to monitor the output 36 and initiate a trouble alarm in the event of a failure. Similarly the power-supply voltage is monitored by a supply-level sensor 58 so that if it drops below a predetermined level, the trouble relay will be de-energized through an "OR" circuit 60. Also, the continuity of the alarm relay coil is continuously monitored by a coil continuity sensor 62 and if the coil becomes open or goes to a high impedance state, the trouble relay will be de-energized through "OR" circuit 60.

The reliability of the balance of the circuitry, amplifier 42, threshold circuit 44, integrator 46, and threshold circuit 48 is increased by duplicating all of the circuitry and then "OR-ing" the outputs of both circuits, through "OR" circuit 64, to activate the alarm relay at the proper time so long as at least one of the circuits is functioning properly. A test switch (not shown in FIG. 3) is provided within the unit to allow simultaneous testing of both arms of the redundant circuits. Use of this switch provides the testor with an indication, at inspection time, that the high-reliability features are still functioning properly, and that the system will continue to function until the next inspection period in the event of a single failure.

Figure 4A:
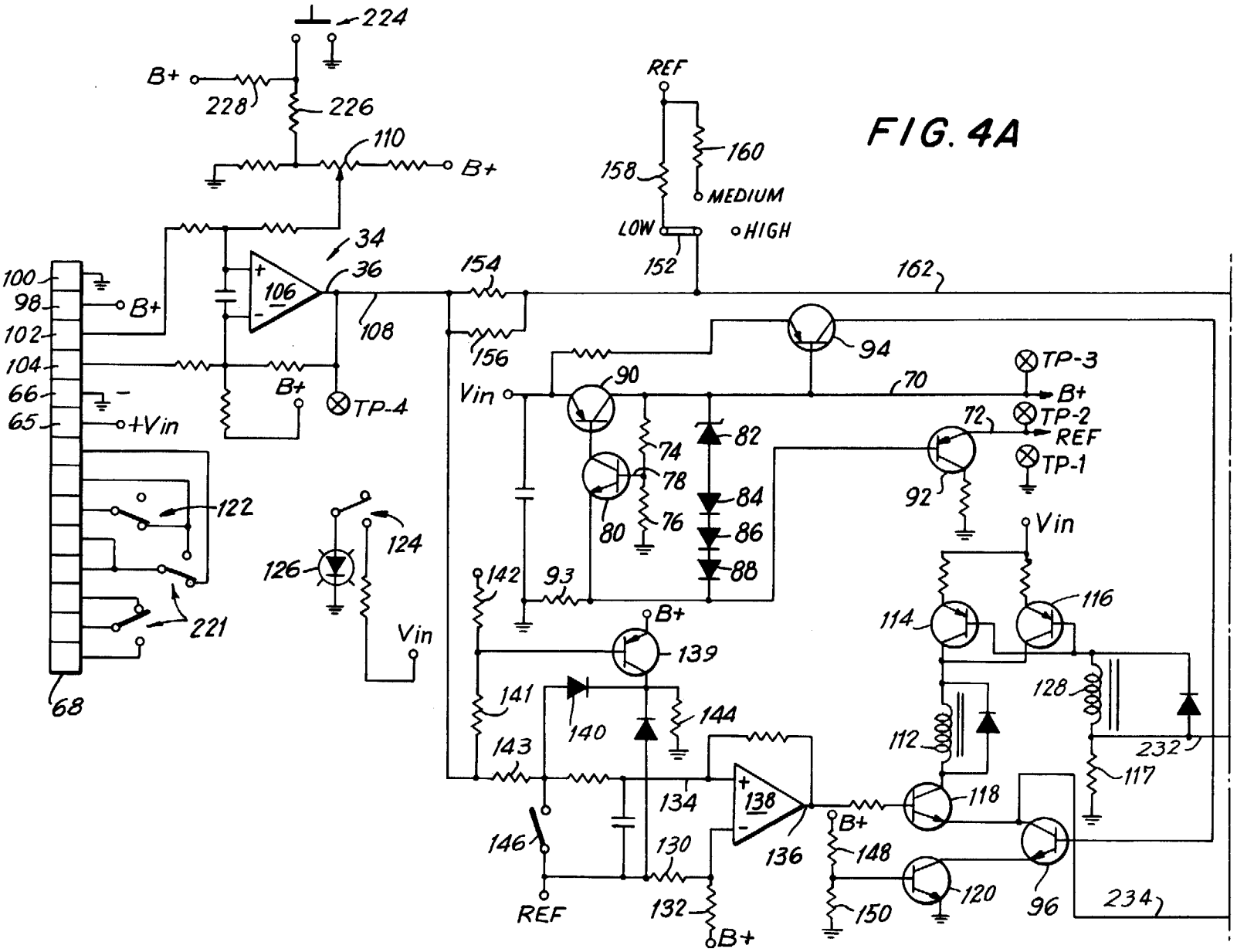
FIGS. 4A and 4B are an electrical schematic diagram of the signal processing circuit of the invention.
Figure 4B:
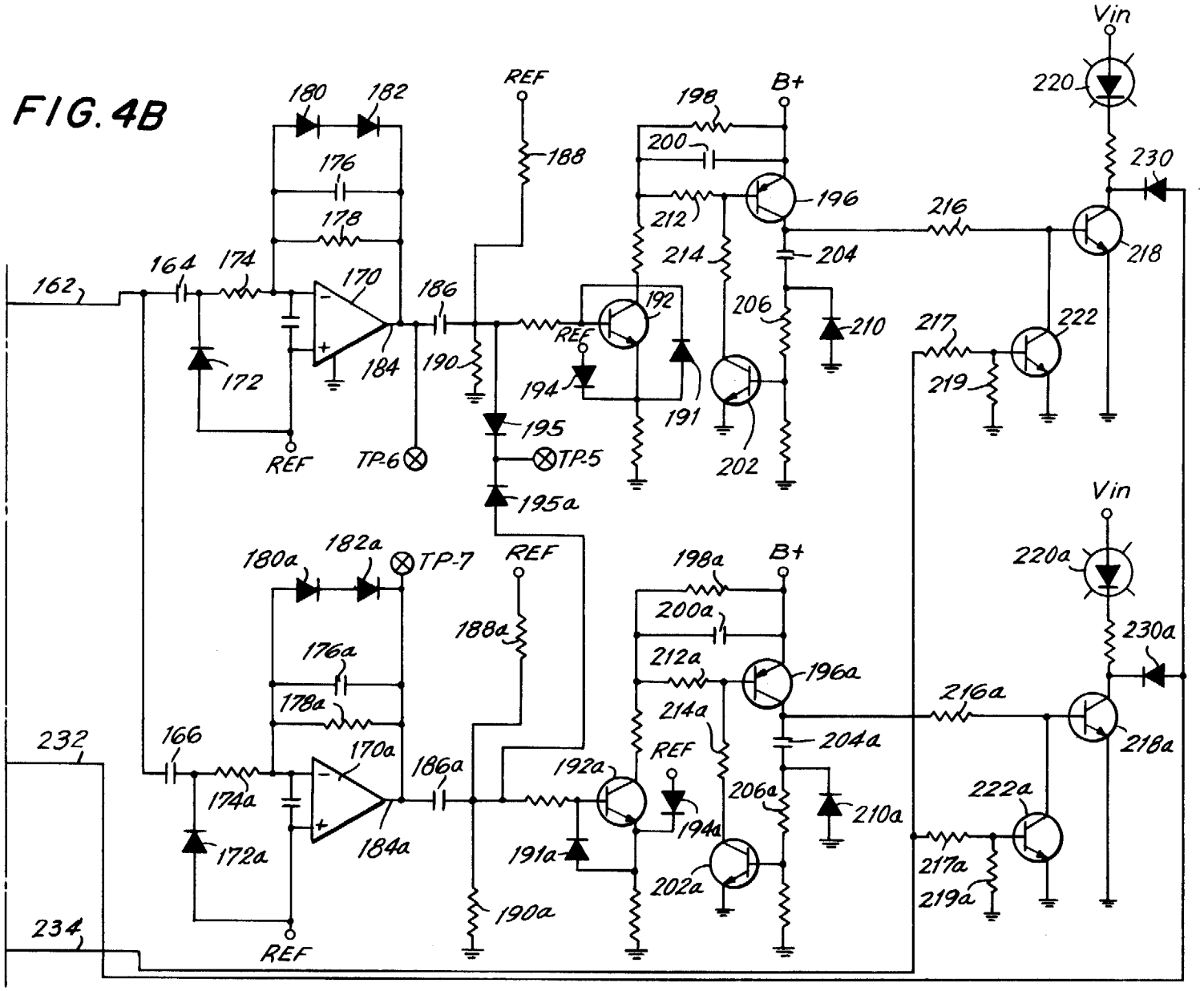

Referring to FIG. 4, which consists of two sheets, FIG. 4A and FIG. 4B, in the preferred embodiment, the electrical signal processing circuit receives unregulated DC input voltage, $V_{in}$, across terminals 65, 66 of a terminal block 68. The input voltage is applied to the filter and series regulator circuit from which B+ (in the preferred embodiment, +10 volts) and REF (in the preferred embodiment, +1.5 volts) are derived over lines 70, 72 respectively. Test points (designated TP-1, TP-2, . . . in FIG. 4) are provided to enable easy inspection of the circuit.

A portion of the regulated output B+ voltage, determined by a voltage divider consisting of resistors 74, 76 is sensed at base 78 of transistor 80. The emitter to base voltage of transistor 80 is determined by the drop across a Zener diode 82 and the total forward drop across diodes 84, 86, 88. (Diodes 84, 86, 88 serve to compensate for the effects of temperature on the Zener diode 82 and the base-to-emitter junction of transistor 80.) By thus determining the emitter to base voltage across transistor 80, transistor 80, operating in accordance with that controlled voltage, provides the necessary base current to the series regulator, transistor 90, to maintain the constant regulated output. Base current for a transistor 92 is provided by the voltage drop across a resistor 93 resulting in a constant REF voltage over line 72.

The voltage drop across transistor 90 is used as the emitter-to-base voltage for a transistor 94. So long as the input voltage $V_{in}$ is sufficient for transistor 90 to regulate properly, transistor 94 is held turned on, and provides base current to hold a transistor 96 turned on. However, just before the input voltage decreases to the point where transistor 90 can no longer regulate properly, the then diminished drop across transistor 90 will not be sufficient to hold transistor 94 turned on. When transistor 94 turns off, base current to transistor 96 ceases and transistor 96 turns off and initiates a trouble alarm as will be described below.

As noted above, fluid pressure in the sealed system is measured by a pressure transducer. A typical preferred transducer is the Linear Variable Differential Transformer type such as Model GS-102 made by the Servonic/Instrumentation Division of Gulton Industries, Inc., Costa Mesa, Cal.

The input power to the pressure transducer is applied over terminals 98, 100 of terminal block 68. A bridge output from the pressure transducer appears across terminals 102 and 104 of terminal block 68 and is applied to a differential DC amplifier 106 (part of amplifier 34). The transducer output voltage increases with pressure, as does the output voltage 36 of amplifier 106 appearing over line 108. In adjusting the circuitry, potentiometer 110 is adjusted to obtain 0 Vdc over line 108 with respect to REF (TP2) for a system pressure of 0 PSIG.

As noted above in connection with FIG. 2, the output 36 of amplifier 34, over line 108, is connected to two operating systems. The absolute-pressure-level operating system is represented, somewhat more elaborately than described in connection with FIG. 2, in the bottom half of FIG. 4A. Here also are other monitor circuits which can collectively be called trouble signal circuits.

A trouble relay is normally energized for the no-trouble condition, and drops out to initiate a trouble signal. Current to hold relay coil 112 of the trouble relay energized is drawn from the unregulated input voltage, $V_{in}$, through parallel redundant transistors 114 and 116, through the relay coil 112, and through transistors 118, 96, and 120, all of which are connected in series to ground. When any of the transistors 114 and 116 (both together), 118, 96, and 120 turn off, relay coil 112 drops out to initiate the trouble signal. Trouble relay contacts 122 provide a trouble signal through terminal block 68 and contacts 124, when trouble relay coil 112 de-energizes, causes trouble light 126 to illuminate.

Parallel transistors 114 and 116 monitor the continuity of normally de-energized alarm relay coil 128. As long as the alarm relay coil is not open or in a high-impedance state, transistors 114 and 116 are kept turned on by base current drawn through resistor 117 and relay coil 128. This base current is too low to energize coil 128. If relay coil 128 should open the base current to transistors 114, 116 will cease and the transistors will turn off causing trouble relay coil 112 to de-energize.

Transistor 118 turns off whenever the pressure in the sealed system exceeds predetermined upper and lower limits. A low pressure detection threshold is set by a voltage divider consisting of resistors 130, 132. Typically, if the voltage on line 134 falls below this threshold, due to system pressure being below 15 PSIG, the output 136 of comparator 138 will be driven to negative saturation, turning transistor 118 off. For system pressures in the acceptable range, the threshold is exceeded, the comparator output 136 goes to positive saturation, and transistor 118 is held on.

Transistor 118 is also turned off when an upper threshold of acceptable pressure is exceeded. For a system pressure of the highest acceptable level or less, transistor 139 is held on, back-biasing diode 140. However, when pressure exceeds the threshold, say 200 PSIG, the high pressure detection threshold set by the voltage divider consisting of resistors 141 and 142 is exceeded, and transistor 139 turns off. With transistor 139 turned off, diode 140 is forward-biased and the DC amplifier output 36 is reduced by the voltage divider consisting of resistors 143, 144 to a value less than the low pressure threshold of resistors 130, 132 described previously. Consequently, for system pressures above or below the acceptable range, comparator 138 is at negative saturation, and for pressures within the acceptable range, comparator 138 is at positive saturation.

A normally open tamper switch, 146, is provided so that when the cover is opened, tamper switch 146 closes, again reducing the comparator 138 input below the low pressure threshold, driving the output 136 to negative saturation, and turning off transistor 118.

As noted above, if $V_{in}$ drops too low for transistor 90 to maintain proper regulation, transistor 94 turns off and causes transistor 96 to turn off. A second voltage check is made on the B+ voltage. If B+ should decrease below a threshold determined by a voltage divider consisting of resistors 148, 150, transistor 120 is turned off initiating a trouble alarm.

The second operating system, the alarm signal circuits, receives the output of amplifer 34 attenuated by the setting of the GAIN jumper 152. In the MEDIUM and LOW positions, gain is reduced by 6 db and 12 db respectively from that obtained in HIGH. The reduced gain results from the voltage divider consisting of paralleled resistors 154, 156 and either resistor 158 or 160. The paralleled resistors, 154, 156, provide for increased reliability through redundancy. If one should fail, system functioning will continue, although with a decrease of 6 db in gain. The resulting signal, is applied to the signal shaping circuitry (FIG. 4B) over line 162.

The signal shaping circuitry consists of two identical processing channels which receive the signal on line 162 through AC coupling capacitors 164, 166. Since the two channels are identical, being redundant to maintain high reliability, only the top channel (FIG. 4B) will be described. Corresponding elements in the lower channel will be labeled with a corresponding reference number followed by the suffix "*a*". The AC coupled signal is applied to an operational amplifier 170 having a gain of approximately 40 db. A diode 172 allows a capacitor 164 to recover from large voltage surges or turn-on transients. In the preferred embodiment amplifier 170 is connected as a band-pass amplifier wherein the low frequency end of the pass-band, set by capacitor 164 and resistor 174, is at 0.025 Hz, while the high frequency end of the pass-band, set by capacitor 176 and resistor 178 is at approximately 1 Hz. Diodes 180, 182 in the feedback path limit the operational amplifier swing in the negative-going direction.

The output voltage 184 of amplifier 170 is inversely proportional to system pressure (signal voltage decreases as pressure increases). With the amplifier output limited in the negative-going direction (by diodes 180, 182) recovery from a large pressure surge will not be seen by the amplifier as a significant voltage drop, thereby avoiding false alarms due to momentary surges in supply pressure.

Capacitor 186 blocks the operational amplifier 170 DC offset, and a quiescent DC level at the output side of capacitor 186 is maintained by the voltage divider consisting of resistors 188, 190. Diode 191 allows capacitor 186 to recover from the effects of negative-going voltage surges.

The emitter voltage of transistor 192 is determined by the forward drop across diode 194. Thus, the base voltage of transistor 192 must be at least equal to REF before the transistor conducts. This will occur for a system pressure drop representative of waterflow due to the activation of a single sprinkler head, if the system gain has been properly set. In a preferred embodiment, system gain can be set as follows. With a voltmeter connected between TP5 (the higher voltage from the two identical channels is presented at TP5 (through diodes 195 and 195*a*)) and REF, the GAIN jumper should be placed in the minimum setting that results in a reading of at least 0.1 Vdc when there is waterflow from an open sprinkler in the system. This procedure will insure that there is sufficient gain margin for reliable operation and that the system is not overgained, thus minimizing false alarm susceptibility. When the base threshold voltage of transistor 192 is exceeded (indicating waterflow), transistor 192 conducts and the base voltage of transistor 196 will fall from B+ at a rate determined by the time constant of resistor 198 and capacitor 200. In the preferred embodiment, after approximately 3 seconds, the base voltage of transistor 196 decreases to the threshold level, turning transistor 196 on. The 3-second retard is provided to be sure that transistor 192 has been turned on by a signal due to continuous waterflow in the system, and not by a momentary system pressure drop unrelated to sprinkler action.

Transistors 196 and 202 together with their associated circuitry form a one-shot multivibrator, with a positive pulse in the preferred embodiment of at least 15 seconds duration obtained at the collector of transistor 196. A minimum pulse duration is determined by the time constant of capacitor 204 and resistor 206. Diode 210 allows rapid recovery of capacitor 204 in anticipation of the next cause for alarm. During the time that transistor 202 is held on (until capacitor 204 discharges) its collector is essentially at ground. Then the divider consisting of resistors 198, 212, and 214 causes transistor 196 to remain on for the pulse duration, regardless of the state of transistor 192.

Although a minimum of one such alarm pulse is guaranteed when waterflow representative of an activated sprinkler head exists, there may be additional alarm pulses generated, depending on how long it takes for system pressure to stabilize at the new reduced level. As additional sprinkler heads turn on, more alarm pulses would be expected.

The positive pulse from the collector of transistor 196 is applied through resistor 216 to the base of transistor 218 turning it on for the 15 second pulse duration. During this time, current through the collector of transistor 218 illuminates the ALARM lamp 220, and the high impedance of resistor 117 is short-circuited to ground by the collector of transistor 218, thereby increasing the coil current to a valve sufficient to energize the relay coil 128 (FIG. 4A). The alarm relay will be energized when either or both transistors 218, 218*a* are turned on, as a short-circuit to ground from either or both transistors is presented, through the "OR" circuit consisting of diodes 230, 230*a,* on line 232 to the junction of alarm relay coil 128 and resistor 117. Alarm relay contacts 221 will change state in the alarm condition to provide, through terminal block 68 an indication of the alarm state to a supervisory location.

Circuitry is also provided to inhibit the generation of an alarm signal while a trouble signal, due to power supply problems only, is being generated. As stated previously, transistor 20 is turned off when the regulated B+ fails, and transistor 96 is turned off when the unregulated $V_{in}$ falls to an unacceptably low level. In either case, a high DC level ($V_{in}$) will appear at the collector of transistor 96 (on line 234) and across the voltage divider consisting of resistors 217 and 219, turning transistor 222 on. With transistor 222 on, the base of transistor 218 is held at ground by transistor 222, thus inhibiting operation of transistor 218 notwithstanding the presence of alarm pulses at the collector of transistor 196. The alarm signal is not inhibited while a trouble signal is generated, if the trouble signal is caused by system pressure being out of limits or by opening the cover.

The preferred embodiment of the invention also includes several test features. When a PUSH TO TEST switch 224 is activated, resistor 226 is returned directly to ground rather than to B+ through resistor 228. This shifts the input voltage, at amplifier 106 in the negative direction by an amount sufficient to simulate the system pressure drop that would be caused by the flow from at least one sprinkler head. For a system test, switch 224 should be held depressed for about 5 seconds -- long enough to be sure that the 3-second retard time is exceeded. Each of the ALARM lamps, 220, 220*a,* should then light and remain lighted for approximately 15 seconds after the release of the switch. Failure of either lamp to function as described indicates a problem in the associated alarm signal processing channel.

The yellow TROUBLE lamp 126 should light when the cover housing the system is opened, and should turn off when the tamper switch plunger of switch 146 is pulled out to a "defeat" position thereby returning the switch to its open circuit condition. If this lamp fails to function as described, the appropriate DC voltages and pressure gauges should be monitored to determine the malfunction.

Other embodiments of the invention will occur to those skilled in the art and are within the following claims.

What I claim is:

1. A sprinkler flow detector for providing an alarm signal when a predetermined condition of fluid flow exists in a sprinkler system which includes a system side containing a fluid under pressure, said system side having at least one outlet port for allowing fluid to escape from the system side and at least one inlet port for admitting fluid into the system side, said detector comprising:

a pressure transducer in communication with said system side for providing a first electrical output signal from which pressure of the fluid in the system side can be determined, and an electrical signal processing circuit for receiving the first electrical output signal from the pressure transducer and for providing the alarm signal whenever the rate of change of the first electrical output signal has a predetermined polarity relative to a predetermined threshold level for a predetermined interval of time, said processing circuit including a band-pass amplifier for providing a second electrical output signal representative of the component of said first output signal within a predetermined frequency range, a threshold detector for producing a third electrical output signal when said second output signal has a predetermined polarity relative to a predetermined threshold level, and means responsive to said third output signal for producing the alarm signal when said third output signal has been produced for a predetermined interval of time.

2. A sprinkler flow detector according to claim 1 in which said signal processing circuit further comprises means for preventing the detector from producing said alarm signal in response to positive fluctuations of pressure within the system side.

3. A sprinkler flow detector according to claim 1 wherein said band-pass amplifier has a low frequency cut-off of substantially 0.025 Hertz and a high frequency cut-off of substantially 1 Hertz.

4. A sprinkler flow detector according to claim 1 wherein said processing circuit includes a high pressure sensing circuit for providing trouble signal whenever the pressure in the system side exceeds a predetermined high pressure threshold level and a low pressure sensing circuit for providing a trouble signal whenever said pressure decreases below a predetermined low pressure threshold level.

5. A sprinkler flow detector according to claim 4 wherein said processing circuit includes means for monitoring the impedance of an alarm relay coil and for providing a trouble signal whenever said impedance exceeds a magnitude that would prevent initiation of a properly initiated alarm signal.

6. A sprinkler flow detector according to claim 4 including means to inhibit said alarm signal in response to an abnormal low supply of DC power and to provide said trouble signal in response to said low supply of DC power.

7. In a sprinkler system containing fluid under pressure and including at least one inlet port for admitting fluid into the system and at least one outlet port for allowing fluid to escape from the system, a flow detector for providing an alarm signal in response to the escape of fluid from one or more of the outlet ports comprising:

a pressure transducer in communication with the system for providing a first electrical output signal proportional to the pressure of the fluid in the system;

a band-pass amplifier for producing a second electrical output signal proportional to the level of the component of said first output signal within a predetermined frequency band;

a first threshold detector for producing a third electrical output signal when said second output signal has a predetermined polarity relative to a predetermined threshold level; and means responsive to said third output signal for producing an alarm signal when said third output signal has been produced for a predetermined interval of time.

8. The flow detector defined in claim 7 further comprising diode means shunting said band-pass amplifier and polarized to prevent the detector from producing said alarm signal in response to an increase in the pressure of the fluid in the system.

9. The flow detector defined in claim 7 wherein said band-pass amplifier has a low frequency cut-off of substantially 0.025 Hertz and a high frequency cut-off of substantially 1 Hertz.

10. The flow detector defined in claim 7 wherein said means for producing an alarm signal comprises:

means for producing a fourth electrical output signal proportional to the time integral of said third output signal; and a second threshold detector for producing said alarm signal when said fourth output signal exceeds a predetermined threshold level.

11. The flow detector defined in claim 7 further comprising a low pressure threshold detector responsive to said first output signal for producing a trouble signal when the pressure of the fluid in the system falls below a predetermined low pressure threshold level.

12. The flow detector defined in claim 7 further comprising a high pressure threshold detector responsive to said first output signal for producing a trouble signal when the pressure of the fluid in the system exceeds a predetermined high pressure threshold level.

13. The flow detector defined in claim 7 further comprising:

a low pressure threshold detector responsive to said first output signal for producing a fifth electrical output signal when the pressure of the fluid in the system falls below a predetermined low pressure threshold level;

a high pressure threshold detector responsive to said first output signal for producing a sixth electrical output signal when the pressure of the fluid in the system exceeds a predetermined high pressure threshold level; and means for producing a trouble signal in response to either said fifth or sixth output signals.

14. The flow detector defined in claim 7 further comprising means responsive to said first output signal for producing a trouble signal when said first output signal is not within predetermined signal limits.

15. The flow detector defined in claim 7 further comprising:

a direct current power supply for supplying power to the electrical elements of the flow detector; and means responsive to the level of the direct current signal supplied by said power supply for inhibiting said alarm signal and for producing a trouble signal when the direct current signal level falls below a predetermined low power threshold level.

16. The flow detector defined in claim 7 wherein said means for producing an alarm signal comprises an alarm relay which is actuated to produce said alarm signal, and wherein said flow detector further comprises means for monitoring the continuity of the coil of said alarm relay and for producing a trouble signal if the continuity of said coil is interrupted.

17. The flow detector defined in claim 16 wherein said means for monitoring the continuity of the coil of said alarm relay comprises:

means for passing a current through said coil which is insufficient to actuate said alarm relay; and means responsive to an interruption in the current through said coil for producing said trouble signal.

18. The flow detector defined in claim 7 further comprising redundant circuit elements corresponding to said band-pass amplifier, said first threshold detector, and said means for producing an alarm signal, for performing the functions of the duplicated circuit elements in the event of failure of any of the duplicated circuit elements.

* * * * *